US007367398B2

(12) United States Patent
Chiesa et al.

(10) Patent No.: US 7,367,398 B2
(45) Date of Patent: May 6, 2008

(54) DEVICE FOR HEATING AND THERMALLY INSULATING AT LEAST ONE UNDERSEA PIPELINE

(75) Inventors: Giovanni Chiesa, San Donato Milanese (IT); Floriano Casola, Gazzada Schianno (IT); François-Régis Pionetti, La Baleine (FR)

(73) Assignee: Saipem S.A., Montigny le Bretonneux (FR)

( * ) Notice: Subject to any disclaimer, the term of this patent is extended or adjusted under 35 U.S.C. 154(b) by 10 days.

(21) Appl. No.: 10/548,856

(22) PCT Filed: Mar. 12, 2004

(86) PCT No.: PCT/FR2004/000619

§ 371 (c)(1),
(2), (4) Date: Sep. 9, 2005

(87) PCT Pub. No.: WO2004/085794

PCT Pub. Date: Oct. 7, 2004

(65) Prior Publication Data

US 2006/0131027 A1 Jun. 22, 2006

(30) Foreign Application Priority Data

Mar. 18, 2003 (FR) ..... 03 03274

(51) Int. Cl.
*E21B 29/12* (2006.01)

(52) U.S. Cl. ..... 166/302; 166/367; 166/272.1; 166/61

(58) Field of Classification Search ..... 166/350, 166/367, 272.1, 61, 288, 302
See application file for complete search history.

(56) References Cited

U.S. PATENT DOCUMENTS

| | | | | | |
|---|---|---|---|---|---|
| 2,707,095 | A * | 4/1955 | Parsons et al. | ..... | 165/135 |
| 3,698,440 | A * | 10/1972 | Matthieu et al. | ..... | 138/149 |
| 3,765,489 | A * | 10/1973 | Maly | ..... | 166/310 |
| 3,768,547 | A * | 10/1973 | Best | ..... | 165/45 |
| 3,933,182 | A * | 1/1976 | Costes | ..... | 138/149 |
| 4,076,476 | A | 2/1978 | Ventura | | |
| 4,408,657 | A * | 10/1983 | Pugh | ..... | 165/45 |
| 6,000,438 | A * | 12/1999 | Ohrn | ..... | 138/149 |
| 6,058,979 | A * | 5/2000 | Watkins | ..... | 138/149 |
| 6,419,018 | B1 | 7/2002 | Naquin et al. | | |
| 6,978,825 | B1 * | 12/2005 | Baylot et al. | ..... | 165/45 |
| 7,069,957 | B2 * | 7/2006 | Hallot et al. | ..... | 138/149 |

FOREIGN PATENT DOCUMENTS

| | | |
|---|---|---|
| FR | 2 821 917 | 9/2002 |

(Continued)

*Primary Examiner*—Thomas A. Beach
(74) *Attorney, Agent, or Firm*—Cohen Pontani Lieberman & Pavane LLP

(57) ABSTRACT

Apparatus for heating and lagging at least one main undersea pipe for conveying a flow of hot effluent. The apparatus includes a covering of thermally insulating material surrounding the main pipe(s), and covered by a leaktight outer protective casing and an internal chamber coaxial with the outer casing. The insulating covering surrounds the internal chamber in an annular space between the outer casing and the internal chamber. The main pipe is contained inside an internal chamber that is preferably cylindrical in shape. A heat-transfer fluid having a maintained temperature surrounds the main pipe contained inside the internal chamber and is circulated inside the internal chamber.

30 Claims, 7 Drawing Sheets

FOREIGN PATENT DOCUMENTS

| | | |
|---|---|---|
| WO | WO 00/40886 | 7/2000 |
| WO | WO 00/49267 | 8/2000 |
| WO | WO 02/063128 A1 | 8/2002 |
| WO | WO 02/066786 A1 | 8/2002 |
| WO | WO 02/103153 | 12/2002 |

* cited by examiner

DEVICE FOR HEATING AND THERMALLY INSULATING AT LEAST ONE UNDERSEA PIPELINE

PRIORITY CLAIM This is a U.S. national stage of application No. PCT/FR2004/000619, filed on 12 Mar. 2004. Priority is claimed on the following application(s): Country: France, Application No.: 03/03274, Filed: 18 Mar. 2003, the content of which is incorporated here by reference.

BACKGROUND OF THE INVENTION

Field of the Invention

The present invention relates to a method and apparatus for heating and lagging at least one undersea pipe at great depth. The invention relates more particularly to bottom-to-surface connection pipes connecting the bottom of the sea to supports floating on the surface.

The technical field of the invention is that of manufacturing and assembling lagging and heating systems outside and around pipes conveying hot effluents from which it is desired to limit heat losses.

The invention applies more particularly to developing oil fields in deep water, i.e. oil installations installed at sea where the surface equipment is generally situated on floating structures, with the wellheads being on the sea bottom. The pipes concerned by the present invention are more particularly the bottom-to-surface connection pipes known as "risers" because they rise to the surface, however the invention also applies to pipes connecting wellheads to said bottom-to-surface connection pipes.

The present invention also relates to a hybrid tower type installation for providing a bottom-to-surface connection for at least one undersea pipe installed at great depth.

The main application of the invention is thermally insulating and heating immersed pipes or ducts, undersea or under water, and more particularly at great depth, in excess of 300 meters (m), and conveying hot petroleum substances which would give rise to problems were they to cool excessively, whether during normal production or in the event of production being stopped. At present, developments in deep water are being performed at depths of 1500 m. Future developments are planned for water at depths of 3000 m to 4000 m and even deeper.

In applications of this type, numerous problems arise if the temperature of the petroleum substances decreases significantly relative to their normal production temperature which is often greater than 60° C. to 80° C., even though the temperature of the surrounding water, particularly at great depth, can be well below 10° C., and can be as little as 4° C. For example, if the petroleum substances cool to below 30° C. to 60° C. from an initial temperature of 70° C. to 80° C., the following are generally observed:

- a large increase in viscosity which diminishes flow rate along the pipe;
- precipitation of dissolved paraffin which not only increases viscosity but is also deposited on the walls and can reduce the effective inside diameter of the pipe;
- flocculation of asphaltenes leading to the same problems;
- sudden, compact, and massive formation of gas hydrates which precipitate at high pressure and low temperature, thereby suddenly blocking the pipe.

Paraffins and asphaltenes remain stuck to the wall, thus requiring the inside of the pipe to be cleaned by scraping; in contrast, hydrates are even more difficult and sometimes even possible to resorb.

In addition, in rising columns, gas mixed with crude oil and water tends to expand as it rises since the hydrostatic pressure decreases. Since this expansion is quasi-adiabatic, heat is taken from the polyphase fluid itself, leading to a significant reduction in its internal temperature, which reduction can be as much as 8° C. to 15° C. for a change in level of 1500 m.

The purposing of lagging and heating such pipes is thus to slow down the cooling of the petroleum effluents being conveyed not only under steady production conditions, for example in order to ensure a temperature of not less than 40° C. on reaching the surface starting from a production temperature on entry into the pipe of 70° C. to 80° C., but also, in the event of production decreasing or even stopping, to ensure that the temperature of the effluents does not drop below 30° C., for example, so as to limit the above-mentioned problems, or at least so as to ensure that they remain reversible.

When installing single pipes or bundles of pipes, it is generally preferable to prefabricate said pipes on land in unit lengths of 250 m to 500 m, which lengths are subsequently towed off-shore by means of a tug. For a tower type bottom-to-surface connection, the length of the pipe generally represents 50% to 95% the depth of the water, i.e. it can be 2400 m for water at a depth of 2500 m. During construction on land, the first unit length is pulled from the sea and the next length is connected to the end thereof, with the tug keeping the assembly under traction during the end-to-end connection stage which can last for several hours or even several days. Once the entire pipe or bundle of pipes has been put into the water, the assembly is towed to the site, generally with the assembly remaining below the surface in a substantially horizontal position, and it is then "up-ended" i.e. tilted into a vertical position, and once it has reached the vertical position it is put into place in its final position.

Apparatus is known for lagging at least one undersea pipe, which may be on its own or associated with other pipes, thereby constituting a bundle for placing on the bottom at great depth, the apparatus comprising an outer insulating covering surrounding the pipe, and an outer protective casing. The lagging around the pipe or the pipes or the bundle of pipes is itself protected by the outer protective casing which performs two functions:

- firstly, it avoids the damage that can occur during construction or during towing or putting into place, particularly in shallow zones, and where said towing can take place in some circumstances over distances of several hundreds of kilometers. For this purpose the materials used are quite strong, such as steel, thermoplastic or thermosetting compounds, or indeed composite materials;
- secondly, it creates leaktight confinement around the lagging system. Such confinement is necessary when the insulating outer coverings are made up of materials that are subject to migration, or indeed comprise fluid compounds.

In depths of 2000 m, hydrostatic pressure is of the order of 200 bars, i.e. 20 megapascals (MPa), which implies that the assembly of pipes and lagging must not only be capable of withstanding such pressures without damage when the pipe that conveys the hot fluid is pressurized and depressurized, but that it must also be capable of withstanding temperature cycles that lead to changes in the volumes of the various components, and thus to positive or negative pressures that can cause the casing to be destroyed partly or completely, either by exceeding acceptable stresses, or by implosion of the outer casing (internal pressure variation then being negative).

Since crude oil is conveyed over long distances, e.g. several kilometers, it is desirable to provide a very high level of insulation, firstly to minimize the increase in viscosity that would lead to a reduction in the hourly production rate of a well, and secondly to prevent flow being blocked by deposits of paraffin or the formation of hydrates whenever the temperature drops to around 30° C.-40° C. These phenomena are particularly critical in West Africa where the temperature of sea water at the bottom is about 4° C. and where the crude oil is of the paraffin type.

Numerous thermal insulation systems are known that enable the required level of performance to be achieved and that are capable of withstanding pressure at the bottom of the sea which is of the order of 150 bars at a depth of 1500 m. Mention is made, amongst others, of concepts of the "pipe-in-pipe" type comprising a pipe conveying the hot fluid installed in an outer protective pipe, with the space between the two pipes being either merely filled with lagging, optionally vacuum-confined, or else merely evacuated. Numerous other insulating materials have been developed for providing high performance insulation, some of them also withstanding pressure. Such insulating materials merely surround the hot pipe and are generally confined within an outer casing that is flexible or rigid, at equalized pressure, and that serves mainly to ensure that shape remains substantially constant over time.

To varying degrees, all of those devices conveying a hot fluid within an insulated pipe present phenomena of differential expansion. The inner pipe is generally made of steel and is at a temperature which it is desired to keep as high as possible, e.g. 60° C. or 80° C., whereas the outer casing, often also made of steel, is at the temperature of sea water, i.e. at around 4° C. The forces generated on the connection elements between the inner pipe and the outer casing are considerable and can reach several tens or even several hundreds of (metric) tonnes, and the resulting overall elongation is of the order of 1 m to 2 m for insulated pipes that are 1000 m to 1200 m long.

Patents WO 00/49263, WO 02/066786, and WO 02/103153 in the name of the Applicant describe various hybrid tower type installations including insulated pipes.

A problem posed in the present invention is that of making and installing such bottom-to-surface connections for undersea pipes at great depths, such as depths greater than 1000 m for example, and of the type comprising a vertical tower transporting fluid that must be maintained above some minimum temperature until it reaches the surface, while minimizing the components that are the subject of heat losses, and avoiding the drawbacks created by the intrinsic or differential thermal expansion of the various components of said tower, so as to better withstand the extreme stresses and the fatigue phenomena that accumulate over the lifetime of the structure, which commonly exceeds 20 years.

Patent WO 00/40886 describes a lagging material making use of solid-liquid phase change and the latent heat of fusion, capable of delivering heat to the inner pipe, and confined around said inner pipe within a deformable and leakproof casing, thus enabling the casing to track the expansion and contraction of the various components under the influence of all the parameters involved, including internal and external temperatures.

More precisely, in WO 00/40886, a solid-liquid phase-change material is used to take advantage of the latent heat of fusion, in which phase change takes place at a temperature $T_0$ that is greater than the temperature $T_1$ at which the oil flowing inside the pipe becomes too viscous, with the temperature $T_1$ generally lying in the range 20° C. to 60° C., and that is less than the temperature $T_2$ of the crude oil on entering the pipe.

In the event of production stopping, this phase-change material (PCM) makes it possible to ensure that the fluid which is normally flowing inside the inner pipe is maintained at a high temperature so as to prevent paraffins or hydrates forming in the oil. Other phase-change materials can be envisaged, such as optionally hydrated salts, that store and restore considerable amounts of energy during changes of phase.

Thus, during stops in production, the crude oil no longer flows and remains stationary within the pipe, so heat is lost to the outside environment, which is generally at 4° C. in very great depths, with this loss of heat being to the detriment of the PCM, while the oil continues to remain at a temperature that is greater than or substantially equal to the temperature of said PCM.

Throughout the stage in which the PCM is solidifying or crystallizing, its temperature remains substantially constant and equal $T_0$, e.g. 36° C., and thus the inner pipe containing the crude oil remains at a temperature greater than or substantially equal to the temperature ($T_0$) of the PCM, i.e. 36° C., thus preventing paraffins or hydrates forming in the crude oil.

The previously-described phase-change materials generally present large variation in volume on changing state, which variation can be as great as 20% for paraffin. The outer protective casing must be capable of accommodating such variations in volume without damage.

That is why, according to WO 00/40886, the PCM is confined within a leakproof casing that is deformable, thus enabling it to track the expansion and contraction of the various components under the influence of all the parameters involved, including internal and external temperatures. The pipe is thus either confined within a flexible thermoplastic casing, in particular one made of polyethylene or polypropylene, e.g. of circular section, with the increase or reduction of internal volume due to temperature variations and comparable to breathing being absorbed by the flexibility of the casing, e.g. constituted by a thermoplastic material having a high elastic limit. In order to withstand mechanical stresses, it is preferable to use a semi-rigid casing made of a strong material such as steel or a composite material, e.g. a composite made from a binder such as epoxy resin and organic or inorganic fibers such as carbon fibers or glass fibers, in which case the casing is given an oval or flattened shape with or without reverse curvature so as to give it, at constant perimeter, a section that is of smaller area than the corresponding circle. Thus, the "breathing" of the casing in the event of volume increasing or decreasing will lead respectively to the casing being returned to a round shape, or to the flattening of said casing being accentuated. Under such circumstances, the bundle and casing assembly is referred to as a "flat bundle", as contrasted with a bundle having a circular casing.

The problem of the present invention is more particularly that of providing an improved system for thermally insulating an undersea pipe or bundle of pipes, which system includes an insulating material, in particular a PCM, presenting behavior when restarting production that is such as to enable production to be restarted in a length of time that is shorter than in the prior art.

In the event of production being stopped for several days or several weeks, it is general practice to take the precaution of purging the line while the PCM remains active, i.e. to cause a substitution substance to flow in a loop so as to keep the assembly safe prior to allowing the temperature of the pipe to drop to around 4° C. The substitution substance may be gas oil, for example. Then, on restarting, the same gas oil is generally used to reheat the pipe by causing it to circulate in a loop from the floating support where it is heated by being passed through boilers or heat exchangers taking heat from gas turbines. Thus, during heating, heat migrates inside the pipe towards the outer ambient medium which is generally at 4° C., and throughout the reheating stage, most of the heat conveyed by the circulating gas oil is absorbed by the PCM, thereby reliquefying it, with this possibly taking several days or several weeks if the pipe is very long, or if the rate at which heat is produced on the floating support is insufficient. It is only after this stage of heating by circulating gas oil that it is possible to reconnect the wellheads and restart production. If production is started prematurely, then the insulating PCM will only be partially liquid and its internal temperature will be less than or equal to $T_0$ (the phase-change temperature), and thus low over the entire length of the undersea pipe, and the following phenomena are then observed.

As the oil leaving the well at high temperature, e.g. 75° C., advances towards the floating production storage and off-loading (FPSO) support, it delivers heat to liquefy the PCM, and in so doing the temperature of the crude oil drops quickly since the PCM is then not performing its function as an insulating system but is performing the opposite function of absorbing heat, leading to accelerated cooling of the crude oil. Thus, after traveling a few kilometers, or possibly even only a few hundreds of meters, the temperature of the oil drops to the critical value $T_1$ at which the unwanted phenomena of hydrate or paraffin plugs forming within the oil flowing in the pipe can occur, thereby leading to the flow of crude oil being blocked. In the zone close to the wellhead, the PCM reliquefies progressively and the front of complete reliquefication advances slowly towards the FPSO. In a zone that is further away, the temperature remains stable at around $T_0$ and liquefication can continue only if the crude oil continues to be at a temperature greater than $T_0$. Thus, with very long lines, e.g. 5 kilometers (km) or 6 km, in a zone that is very far from the source of heat, i.e. close to the FPSO, there is no longer enough heat being delivered and the PCM loses heat to the ambient medium at 4° C. In order to supply this heat it is transformed progressively to the solid state.

For pipes that are very long, it can thus be seen that on restarting, the PCM in the zone close to the wellheads can be reliquefying while at the other end, close to the FPSO, the PCM is resolidifying, since the rate at which heat is being lost to the ambient medium is greater than the rate at which heat is being delivered by the crude oil flowing in the pipe. The PCM is waiting for a hot front of crude oil which will convert it back into the liquid phase.

OBJECT AND SUMMARY OF THE INVENTION

An object of the present invention is thus to provide a pipe insulation system that enables heating to be performed so as to maintain the effluent flowing in an undersea pipe at a temperature above a fixed value so that after a prolonged stoppage, the duration of the restarting stage is shortened, for example making it possible, where appropriate, merely to heat the pipe partially without needing to wait for all of the PCM, if any, to be completely liquefied.

To do this, the invention provides apparatus for heating and lagging at least one undersea main pipe for carrying a flow of hot effluent, the apparatus comprising:

a covering of at least one thermally insulating material surrounding said main pipe(s);

said insulating covering being covered by a leaktight outer protective casing that is preferably cylindrical in shape;

the apparatus being characterized in that it comprises:

a) an internal chamber preferably of cylindrical shape and coaxial inside said outer casing, such that:

said insulating covering surrounds said internal chamber and preferably fills the annular space between said outer casing and said internal chamber; and said main pipe is contained inside said internal chamber, that is preferably cylindrical in shape; and b) means suitable for maintaining the temperature of a heat-transfer fluid and for causing it to circulate inside said internal chamber, said heat-transfer fluid surrounding the main pipe contained inside a said internal chamber.

In an advantageous embodiment, said internal chamber conveys at least one internal gas-injection pipe suitable for enabling gas to be injected into said main pipe, said internal gas-injection pipe being connected to said main pipe at one end in the longitudinal direction of said main pipe inside said internal chamber, and preferably said gas-injection pipe extending outside said internal chamber in the form of an external gas-injection pipe connecting said internal gas-injection pipe to a floating support.

Injecting gas into the bottom of a riser type bottom-to-surface connection creates bubbles within the upwardly-rising effluent, thereby reducing its density and thus encouraging said effluent to rise. This "gas-lift" technology is well known to the person skilled in the art and is not described in greater detail herein.

In a particular embodiment, said internal chamber comprises both fluid-circulation means for circulating a heat-transfer fluid, said fluid-circulation means comprising at least one internal heat-transfer fluid feed pipe extending in the longitudinal direction inside said internal chamber from a first orifice situated at a first end of the internal chamber, preferably as far as the vicinity of the second end of said internal chamber, and a second orifice for outlet of said heat-transfer fluid, preferably level with said first end of the internal chamber, said internal heat-transfer fluid feed pipe being situated beside said main pipe, between it and said outer insulating material.

Because the heat-transfer fluid feed pipe runs along practically the entire length of the internal chamber, it can also contribute to heating the inside of the internal chamber. Advantageously, orifices can be placed on said heat-transfer fluid feed pipe at intermediate levels so that some of the hot heat-transfer fluid is transferred directly into the internal chamber at said intermediate levels.

In which case, and advantageously, said internal gas-injection pipe is a pipe that is spiral-wound around said internal heat-transfer fluid feed pipe inside said internal chamber, preferably a rigid pipe shaped into a spiral.

This embodiment is particularly advantageous since it makes it possible to establish a reserve for possible elongation of said internal gas-injection pipe when said main pipe is subjected to variations in length due to variations in the temperature of the hot effluent flowing inside it.

In addition, this configuration for the internal gas-injection pipe spiral-wound around the internal heat-transfer fluid feed pipe also enables the gas to be heated prior to being injected into the main pipe, thereby improving the performance of gas-lift.

In a first variant embodiment, said internal heat-transfer fluid feed pipe is extended from said first orifice to a floating support by an external flexible pipe for feeding said heat-transfer fluid, and said second orifice for outlet of heat-transfer fluid is connected to a second external flexible pipe for returning said heat-transfer fluid to said floating support.

In this variant embodiment, said heat-transfer fluid can be heated on board said floating support by causing it to pass through boilers or heat exchangers, in particular heat exchangers for recovering heat coming from gas turbines, for example.

In a second variant embodiment, said internal heat-transfer fluid feed pipe is connected to heat-transfer fluid circulation means comprising a pump co-operating at said first end of the internal chamber with said first orifice for feeding heat-transfer fluid and with said second orifice for outlet of heat-transfer fluid, said pump enabling the heat-transfer fluid to be circulated successively inside said internal heat-transfer fluid feed pipe, then inside the internal chamber, then out from said internal chamber via said second orifice, then recirculating in a loop back into said internal chamber via said first orifice, an external pipe for conveying heat-transfer fluid between said floating support and the pump body or said first orifice enabling the quantity of heat-transfer fluid in circulation in the chamber and in the various pipes to be adjusted.

Preferably, in this second variant embodiment, the apparatus of the invention includes heater means for heating the heat-transfer fluid inside said internal heat-transfer fluid feed pipe, the heater means preferably being in the form of an electrical resistance element.

This heater means enables the heat-transfer fluid to be heated very effectively since the electrical resistance element constitutes an element that is very simple and easy to power from the floating support by means of a cable that is of small dimensions, providing a high voltage is used. In addition, the quantity of energy transferred to the heat-transfer fluid can easily be adjusted by varying the voltage or the current or both.

In a preferred embodiment, the apparatus of the invention includes at least one transverse end partition at at least a said first end, said end transverse partition supporting said main pipe and also said fluid-circulation means, and having said main pipe passing therethrough and, where appropriate, having first and second orifices enabling said heat-transfer fluid to be caused to circulate inside and outside said internal chamber via said orifices.

In a more particular embodiment, the apparatus of the invention has first and second transverse end partitions each at a respective one of the two ends of the internal chamber, said first end partition including, where appropriate, said first and second orifices, and said two transverse end partitions supporting said outer casing and said internal chamber and connecting them together in leaktight manner, while also ensuring, at least at a first end, that the heat-transfer fluid is confined inside the internal chamber.

Preferably, the apparatus of the invention includes a second end partition including a large orifice of diameter greater than that of the main pipe, through which orifice said main pipe passes, so that the heat-transfer fluid is in contact with sea water at the bottom end of the internal chamber. This embodiment is more particularly suitable when the heat-transfer fluid is a non-polluting fluid such as fresh water, as explained in detail below. This embodiment makes it possible to avoid the difficulties that can arise from differential expansion between the main pipe and the internal chamber.

In another embodiment, said second end partition includes an orifice surrounding and secured to a tubular sleeve inside which said main pipe can slide with little clearance, preferably in leaktight manner. This embodiment is more particularly suitable when the heat-transfer fluid is a polluting fluid.

In all cases, it is advantageous for said main pipe to be covered in a second insulating covering, at least at said second end of the internal chamber, said heat-transfer fluid circulating in said internal chamber outside said second covering.

More particularly, said second covering is constituted by a thermally insulating material, preferably a solid thermally insulating material, more preferably syntactic foam, said solid material directly surrounding said main pipe, more preferably said second insulating material completely filling the space between said main pipe and a second pipe that is coaxial therewith, having said main pipe inserted therein.

In a particularly advantageous embodiment of the present invention, said insulating covering comprises an insulating material that is subject to migration, and at least said outer casing and/or said internal chamber is/are constituted by a solid material that is flexible or semi-rigid and suitable for tracking deformations of the insulating material and for remaining in contact therewith when it deforms.

As mentioned above, said insulating material is a phase-change material presenting a liquid/solid melting temperature ($T_0$) that preferably lies in the range 20° C. to 80° C., said temperature being greater than the temperature ($T_2$) of the sea water environment surrounding the pipe in operation and less than the temperature ($T_1$) above which the effluent flowing inside the pipe presents an increase in viscosity that is damaging for flow thereof in said pipe.

The term "insulating material" is used herein to mean a material that presents thermal conductivity that is preferably less than 0.5 watts per meter per kelvin ($W \cdot m^{-1} \cdot K^{-}$), and that lies preferably in the range 0.05 $W \cdot m^{-1} \cdot K^{-1}$ to 0.2 $W \cdot m^{-1} \cdot K^{-1}$.

Said insulating PCM is selected in particular from materials at least 90% constituted by chemical compounds selected from alkanes, in particular having a hydrocarbon chain with at least 10 carbon atoms, or optionally hydrated salts, glycols, bitumens, tars, waxes, and other fatty materials that are solid at ambient temperature such as tallow, margarine, or fatty alcohols and fatty acids, and the material is preferably incompressible and constituted by paraffin having a hydrocarbon chain with at least 14 carbon atoms.

More particularly, said insulating phase-change material comprises chemical compounds from the alkane family, preferably a paraffin having a hydrocarbon chain with at least fourteen carbon atoms.

Still more particularly, said paraffin is heptacosane of formula $C_{17}H_{36}$, or preferably tetracosane of formula $C_{24}H_{50}$, presenting a melting temperature of about 50° C. This makes it possible to use an industrial paraffin cut centered on heptacosane or on tetracosane.

In an embodiment, said insulating material comprises an insulating mixture comprising a first compound consisting in a hydrocarbon compound such as paraffin or gas oil, mixed with a second compound consisting in a gelling compound and/or a compound having a structuring effect, in particular by cross-linking, such as a second compound of the polyurethane type, cross-linked polypropylene, cross-linked polyethylene, or silicone, preferably said first compound is in the form of particles or microcapsules dispersed within a matrix of said second compound, and, as first compounds, mention can be made more particularly of chemical compounds from the family of alkanes, such as paraffins or waxes, bitumens, tars, fatty alcohols, glycols, and even more particularly of compounds having material melting temperatures lying between the temperature $T_1$ of the hot effluent flowing in one of the pipes and the temperature $T_2$ of the medium surrounding the pipe in operation, i.e., in general, a melting temperature lying in the range 20° C. to 80° C.

These various insulating materials are materials that are "subject to migration", i.e. materials that are liquid, semi-liquid, or of solid consistency such as the consistency of a fat, a paraffin, or a gel, that are capable of being deformed by the stresses that result from differential pressures between two distinct points of the casing, and/or by variations in temperature within said insulating material.

That is why, in a preferred embodiment, the apparatus of the present invention includes a said insulating covering comprising at least one said viscous solid material that is subject to migration and at least two intermediate transverse partitions that are leaktight, each of said intermediate transverse partitions being constituted by a closed rigid structure having said internal chamber passing therethrough and secured to the walls of said internal chamber and to said outer casing, said intermediate transverse partitions preferably being spaced apart from one another at regular intervals along the longitudinal axis of said internal chamber and outer casing coaxial therewith, more preferably at a distance of 50 m to 200 m.

This rigid structure secured to the casing prevents said casing from moving in register with said partition and relative thereto, thus "freezing" the shape of the cross-section of the casing at said partition. The terms "leaktight" and "closed" are used to mean that said partition does not enable the material constituting said insulating covering to pass through said partition, and in particular the junction between said pipe and the orifices via which said pipe passes through said intermediate transverse partition does not allow said insulating covering material to pass through.

Said leaktight intermediate transverse partitions serve to confine said insulating material(s) subject to migration constituting said insulating covering between said casing and said partitions.

In a bottom-to-surface connection, e.g. the vertical portion of a tower or even the catenary section connecting the top of the tower to the surface support, or pipes resting on a steep slope at the bottom of the sea, outside pressure varies along the pipe and decreases on rising towards the surface. With insulating materials that are semi-liquid or fluid, the material presenting specific gravity less than that of sea water, generally of the order of 0.8 to 0.85, the differential pressure between the outside and the inside will vary along said pipe, increasing on rising towards the surface. Thus, it follows that deformation is accentuated in portions presenting the greatest pressure differential, thereby leading to large transfers of fluid parallel to the longitudinal axis of said pipe. In addition, the transfers are amplified by the "breathing" phenomena due to temperature variations as described above.

A "flat" bundle is relatively insensitive to pressure variations due to changes in level: excess pressure low down, low pressure high up, and the towing stage is critical since length can reach several kilometers, the "bundle" never in fact being accurately horizontal which leads to significant variations in differential pressure during towing, and above all during the up-ending operation.

When the bundle is in the vertical position or on the bottom of the sea on a steep slope, the pressure differential created by the low density of the insulating material, associated with the variation in volume created by thermal expansion of the insulating material leads to movements in the insulating material that the outer casing must be capable of accommodating. It is desirable to prevent particles moving parallel to the axis of the bundle, i.e. to prevent insulating material migrating between two zones of the bundle that are far apart, since that runs the risk of destroying the structure proper of the insulating material.

This apparatus with leakproof intermediate transverse partitions thus enables a bundle to be constructed at lower cost on land, making it possible to put into place a covering of insulating material of semiliquid or semisolid type, to tow the apparatus while under the surface, and to up-end it into a vertical position for installation purposes, while nevertheless ensuring that the assembly is not damaged prior to being put into production and throughout its production lifetime, which generally exceeds 30 years.

This apparatus with leakproof intermediate transverse partitions also makes it possible to insulate at least one undersea pipe that is be laid on the bottom, in particular at great depth, and in particular in steeply sloping zones, using a leakproof casing of the flat bundle type that is capable of providing significant transverse flexibility in order to absorb variations in volume while nevertheless conserving sufficient longitudinal rigidity to make handling possible, such as during construction on land, towing to the site, and conserving the mechanical integrity of said casing throughout the lifetime of the apparatus which can reach or exceed 30 years.

In a particular embodiment, said closed structure of said leakproof intermediate transverse partition comprises a cylindrical piece of cross-section whose perimeter presents the same fixed shape as that of said cross-section of the casing.

The term "cross-section" is used to mean section in a plane XX', YY' perpendicular to the longitudinal axis ZZ' of said casing, said casing being tubular in shape and presenting a central longitudinal axis ZZ', and preferably the cross-section of said casing defines a perimeter presenting two axes of symmetry XX' and YY' that are perpendicular to each other and to said longitudinal axis ZZ'.

In the present description, the term "perimeter of the cross-section" is used to mean the closed curved line that encompasses the plane surface defined by said cross-section.

The perimeter of the cross-section of the outer casing at the leakproof partitions is of fixed shape and therefore cannot deform by the casing contracting or expanding at this point.

In various embodiments, said cross-section of the outer envelope is circular in shape, or oval in shape, or indeed rectangular in shape, preferably with rounded corners.

Said leaktight intermediate transverse partitions create thermal bridges. It is therefore desirable to space them apart as far as possible in order to reduce the thermal bridges.

In a particular embodiment, the spacing between two successive ones of said leaktight intermediate transverse partitions along said longitudinal axis ZZ' of said casing lies in the range 50 m to 200 m, and in particular in the range 100 m to 150 m.

In order to reduce the number of leaktight intermediate transverse partitions, according to a preferred characteristic, the apparatus comprises at least one and preferably a plurality of shaping templates each constituted by a rigid structure secured to said internal chamber which passes therethrough and secured to said outer casing at its periphery, being disposed between two of said leaktight intermediate transverse partitions that are disposed in succession, each shaping template presenting openings allowing the material constituting said insulating material that is subject to migration to pass through said shaping template.

Like said leaktight intermediate transverse partition, said shaping template freezes the shape of the cross-section of the outer casing and of the internal chamber at the level of said shaping template, while nevertheless minimizing heat bridges.

More particularly, said open structure of said shaping template comprises a cylindrical piece of cross-section whose perimeter is inscribed in a geometrical figure identical to the geometrical figure defined by the shape of the perimeter of the cross-section of said leaktight partition.

Preferably, an apparatus of the invention includes a plurality of shaping templates disposed along said longitudinal axis ZZ' of the casing, preferably at regular intervals, two successive shaping templates being preferably spaced apart by a distance lying in the range 5 m to 50 m, and more preferably in the range 5 m to 20 m.

In a preferred embodiment, the apparatus of the invention further includes at least one centralizing template and preferably a plurality of centralizing templates preferably disposed at regular intervals between two of said leaktight intermediate transverse partitions in succession along said longitudinal axis, each centralizing template being constituted by a rigid piece secured to the wall of the internal chamber or of said outer casing, and presenting a shape which allows limited displacement of said outer casing or respectively of said internal chamber in contraction and in expansion facing said centralizing template, at least said outer casing or respectively said internal chamber being made of a material that is flexible or semi-rigid and suitable, where appropriate, for remaining in contact with the insulating covering when it deforms.

More particularly, said centralizing template is preferably constituted by a rigid piece having an outer free surface or respectively an inner free surface that is cylindrical with the perimeter of the cross-section being set back from said outer casing or respectively from said internal chamber, thereby restricting deformation of said outer casing or respectively of said internal chamber by mechanical abutment against said rigid piece at at least two opposite points of the perimeter of the cross-section of said outer casing or respectively of said internal chamber. Said displacement of the outer casing or respectively of said internal chamber in register with said centralizing template may represent variations lying in the range 0.1% to 10%, and preferably in the range 0.1% to 5% of the distance between the two opposite points of the perimeter of the cross-section of said outer casing or respectively of said internal chamber. Thus, said rigid piece constituting said centralizing template presenting a portion of its outer free surface or respectively of its inner free surface that is set back sufficiently from the surface of the outer casing or respectively of the internal chamber, and/or presenting through perforations, serves to create a space that allows the material constituting said insulating covering to pass through said centralizing template.

The centralizing template seeks to ensure that there is at least a minimum covering of insulating material around said internal chamber in the event of the casing being deformed by contraction, with said movable material being transferred between said two leaktight partitions.

More particularly, said centralizing template presents a cross-section of perimeter that can be inscribed inside a geometrical figure that is substantially geometrically similar to the geometrical figure defined by the perimeter of the cross-section of said leaktight intermediate transverse partition.

The distance between two centralizing templates along said longitudinal axis ZZ' is such as to ensure that a sufficient quantity of said material constituting said insulating covering is maintained to guarantee the minimum covering needed for thermally insulating said internal chamber, given the contraction deformation to which said outer casing and/or said internal chamber might be subjected.

Advantageously, the apparatus of the invention includes a plurality of centralizing templates, and two successive centralizing templates are spaced apart along said longitudinal axis ZZ' of the casing at distances of 2 m to 5 m.

These various leaktight intermediate transverse partitions, centralizing templates, and shaping templates are described in FR 2 821 915 in a different configuration since there they are directly secured to the undersea pipe conveying the effluent.

As mentioned above, and advantageously, said outer casing and said internal chamber are coaxial along a longitudinal axis ZZ' and define a perimeter presenting, at rest, two axes of symmetry XX' and YY' that are mutually perpendicular and perpendicular to said longitudinal axis ZZ', and at least one of the walls constituting said outer casing and/or said internal chamber is made of a material that is flexible or semi-rigid (i.e. suitable for tracking the deformations of the insulating material and suitable for remaining in contact therewith when it deforms), while preferably the other wall is constituted by a material that is rigid, and more preferably of cross-section that is circular in shape.

In a first variant embodiment, said internal chamber is made of a rigid material and said outer casing is made of a material that is flexible or semi-rigid.

In various embodiments, the cross-section of the outer casing and/or of the internal chamber is/are circular in shape, or oval in shape, or indeed rectangular in shape, preferably with rounded corners.

When the apparatus includes at least two pipes disposed in the same plane, the cross-section of said outer casing or of said internal chamber is preferably elongate in the same direction as said plane.

More particularly, and as described in WO 00/40886, the outer perimeter of the cross-section of said outer protective casing or of said internal chamber is a closed curve for which the ratio of the square of its length over the area it defines is not less than 13.

During variations in internal volume, the outer casing or said internal chamber then tends to deform towards a circular section, which mathematically speaking constitutes the shape having the greatest area for constant perimeter.

With a circular profile, an increase in volume leads to stresses in the wall which are associated with an increase in pressure that results from said increase in volume.

In contrast, if the shape of the cross-section is flattened, then the casing or the internal chamber has greater capacity to absorb expansion due to the expansion of the various components under the effect of temperature, without leading to significant extra pressure since the shape of the casing can become rounder.

With a profile of oval shape, variation of internal pressure leads to a combination of bending stresses and pure traction stresses since the varying curvature of the oval then behaves like an architectural vault, except that with the present casing, the stresses are in traction and not in compression. Thus, a shape that is oval or near to oval can be envisaged for small expansion capacities and ovals should be considered that have ratios of major axis ρmax over minor axis ρmin that are as high as possible, for example at least 2/1 or 3/1.

The shape of the casing should then be selected as a function of the overall expansion of the volume of the insulating outer covering under the effect of temperature variations. Thus, for an insulation system mainly using materials that are subject to expansion, a rectangular shape, a polygonal shape, or an oval shape enables expansion by bending of the wall while inducing minimum traction stresses in the outer casing.

In a first embodiment, the cross-section of the outer casing, which is preferably made of a material that is rigid, is circular in shape, while the cross-section of said internal chamber, which is preferably made of a material that is flexible or semi-rigid, is oval in shape or rectangular in shape with rounded corners.

In another embodiment, the cross-section of the internal chamber, which is preferably made of a material that is rigid, is circular in shape, while the cross-section of the outer casing, which is preferably made of a material that is flexible or semi-rigid, is oval in shape or rectangular in shape with rounded corners.

Also advantageously, said main pipe and, where appropriate, said internal heat-transfer fluid feed pipe, co-operate(s) inside said internal chamber with centralizing elements which hold said pipe(s) substantially parallel to the axis ZZ' of said internal chamber while allowing said pipes to move due to differential expansion thereof along said axis ZZ'.

The present invention also provides apparatus for heating and thermally insulating a bundle of main undersea pipes, the apparatus being characterized in that it includes lagging and heating apparatus of the invention with at least two of said main pipes disposed in parallel inside said internal chamber.

The invention also provides a bottom-to-surface connection installation between an undersea pipe resting on the sea bottom, in particular at great depth, and a supporting float 10, the installation comprising:

a) at least one vertical riser connected at its bottom end to at least one said undersea pipe resting on the sea bottom, and at its top end to at least one float, said vertical riser being included in lagging and heating apparatus of the invention, said vertical riser corresponding to said main pipe, and said internal chamber extending over a depth of at least 1000 meters;

b) at least one connection pipe, preferably a flexible pipe, connecting a floating support with the top end of said vertical riser; and c) where appropriate, said external flexible pipes for circulating the heat-transfer fluid between the floating support and said first and second orifices at the first end of the internal chamber, and, where appropriate, at least one said flexible external pipe for injecting gas.

Preferably, the connection between the bottom end of the vertical riser and a said undersea pipe resting on the sea bottom takes place via an anchor system comprising a base placed on the bottom, said base serving to hold and guide junction elements between the bottom end of the vertical riser and the end of said pipe resting on the sea bottom, said junction elements including a pipe bend element and a pipe coupling element, preferably a single coupling element, and more preferably a single automatic connector, with said vertical riser including in its bottom terminal portion a flexible joint enabling the vertical portion of the riser situated above said flexible joint to move angularly, said junction elements comprising said flexible joint or a portion of vertical riser situated beneath said flexible joint.

The term "vertical" riser is used herein to refer to the ideal position for the riser when it is at rest, it being understood that the axis of the riser can be subjected to angular movements relative to the vertical, with the riser moving within a cone of angle α whose apex corresponds to the point where the bottom end of the riser is fixed to said base.

Said coupling elements, in particular of the automatic connector type, are known to the person skilled in the art and provide locking between a male portion and a complementary female portion, said locking being designed to be performed very simply at the bottom of the sea by using a remotely operated vehicle (ROV) controlled from the surface, without requiring direct manual action by personnel.

The installation of the present invention is advantageous since it presents relatively static geometry for said junction elements relative to said base, and more particularly to said moving support, said junction elements being held rigidly on said moving support. The bottom portion of the tower is thus properly stabilized and does not withstand any forces, in particular at the coupling between the vertical riser and the pipe resting on the sea bottom, since movements in longitudinal translation of the moving support lead to flexing of the end of the undersea pipe resting on the sea bottom, said flexing being capable of absorbing deformation in lengthening or retraction of the undersea pipe under the effects of temperature and pressure, thereby avoiding creating considerable thrust forces within the undersea pipe, which forces can be as great as 100 or even 200 tonnes or more, and would otherwise be transmitted to the foundation structure of the riser tower.

In a preferred embodiment, said vertical riser has a flexible joint in its bottom terminal portion, which joint is preferably reinforced and enables the portion of said vertical riser situated above said flexible joint to move through an angle α, said junction elements comprising said flexible joint or a portion of vertical riser situated beneath said flexible joint.

A flexible joint allows large variation in the angle α between the axis of riser and its ideal vertical position when at rest without leading to significant stresses in the portions of pipe that are situated on either side of the flexible joint: such flexible joints are known to the person skilled in the art and can be constituted by a spherical ball with a sealing gasket, or by a laminated ball made up of sandwiched sheets of elastomer and metal sheet bonded thereto, capable of accommodating large angular movements by deforming the elastomer sheets, while nevertheless maintaining complete leaktightness because of the absence of any rubbing joint surfaces. As a general rule, said angle α lies in the range 10° to 15°.

In all cases, said flexible joint is hollow so as to pass fluid, and its inside diameter is preferably the same as the diameter of the adjacent pipes connected thereto, and in particular equal to that of the vertical riser.

The term "reinforced flexible joint" is used herein to mean a joint capable of transferring to the moving support the vertical forces created by the tension generated by the under-surface float, and the horizontal forces created by swell, and currents acting on the vertical portion of the riser, on the float, and on the flexible connection to the floating support, and also by displacements of said floating support.

When said junction elements include a said flexible joint, said flexible joint is thus held fixed relative to said moving support. Said flexible joint then corresponds to a terminal element of the junction elements, providing the junction with said vertical riser.

Because of the presence of the flexible joint, and because of the flexible connection to the floating support situated at the top of the vertical riser, horizontal displacement of the base of the vertical riser which is at a point of substantially fixed altitude does not lead to any significant force in the hinged assembly constituted by said moving support, said flexible joint, said riser, and said connection to the surface support, under the effect of displacements of said moving support within said base platform, which displacements do not in general exceed 5 m.

A known method of acting on the inside of pipes is referred to as the "coiled-tubing" method which consists in pushing a rigid tube of small diameter, generally 20 millimeters (mm) to 50 mm along the inside of the pipe. The rigid tube is stored by being wound merely by bending on a drum, and is then untwisted while being unwound. Said tube can be several thousand meters long in a single length. The end of the tube situated on the storage drum is connected via a rotary joint to a pumping device capable of injecting liquid at high pressure and high temperature. Thus, by pushing the fine tube along the pipe and by maintaining pumping and pressure, the pipe can be cleaned by injecting a hot substance capable of dissolving plugs. This method of taking of taking action is commonly used on vertical wells or pipes that have become obstructed by paraffin or hydrates forming, which phenomena occur often and are to be feared in all installations that produce crude oil. The coiled-tubing method is referred to below as coiled-tubing cleaning or CTC.

The installation of the invention thus advantageously includes a swanneck-shaped device providing the connection between the top end of said riser and a pipe connecting it to the floating support, so as to make it possible to act on the inside of said vertical riser from the top portion of the float through said swanneck device, so as to access the inside of the riser and clean it by injecting liquid and/or by scraping the inside wall of said riser, and then where appropriate the inside wall of said undersea pipe resting on the sea bottom.

Also advantageously, the installation of the invention has an outer second casing of circular cross-section containing at least one lagging and heating apparatus of the invention, said outer casing of said lagging and heating apparatus of the invention being secured to said second outer casing, preferably by resilient connections, and more preferably said second outer casing has spiral-shaped means on its outside periphery suitable for preventing the formation of vortices and the separation of turbulence under the effect of sea currents.

This embodiment is particularly advantageous when the lagging and heating apparatus of the invention has an outer casing of cross-section that is not circular or when the installation has at least two of said lagging and heating apparatuses with their two outer casings side by side whether they are circular or non-circular in cross-section.

The present invention also provides a method of heating and thermally insulating at least one main undersea pipe for providing a bottom-to-surface connection for conveying a flow of hot effluent to the sea bottom or from the sea bottom to the surface, characterized in that a heating and lagging apparatus of the invention is used, preferably in an installation of the invention, with a said heat-transfer fluid being caused to circulate inside said internal chamber.

In a particular embodiment, said heat-transfer fluid is selected from sea water, fresh water, gas oil, and oil.

Preferably, the heat-transfer fluid is selected to have specific gravity less than that of water so that it contributes to providing buoyancy for the lagging and heating apparatus of the present invention, in particular it can be constituted by gas oil having specific gravity of about 0.85.

It is advantageous to use a heat-transfer fluid of large specific heat per unit mass such as sea water or fresh water, but fresh water is preferable since it remains less aggressive to the metal walls of the internal chamber and when additives are included for avoiding the proliferation of algae and other organisms, said additives will remain for a long time within the circulating fresh water merely because of the difference in density relative to sea water with the interface between the two fluids being located at the bottom of the rising column where it is little disturbed.

The heating and thermal insulating method of the invention is particularly advantageous when heating said main pipe by circulating said heat-transfer fluid during a stage of restarting production after a prolonged stop.

BRIEF DESCRIPTION OF TILE DRAWINGS

Other characteristics and advantages of the present invention appear better on reading the following description given by way of non-limiting illustration and with reference to the accompanying drawings, which:

FIG. 1 is a side view of a bottom-to-surface connection of the riser tower type connecting an undersea pipe 13 resting on the sea bed 30 to a floating support 10 on the surface 31;

Figure 2:
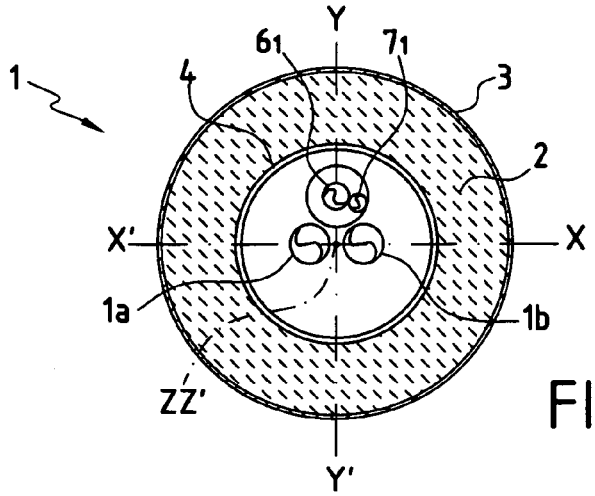
Figure 3:
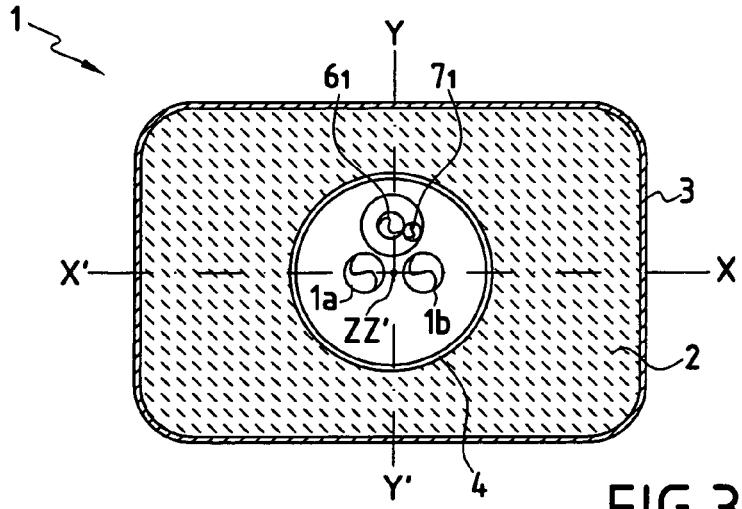
Figure 4:
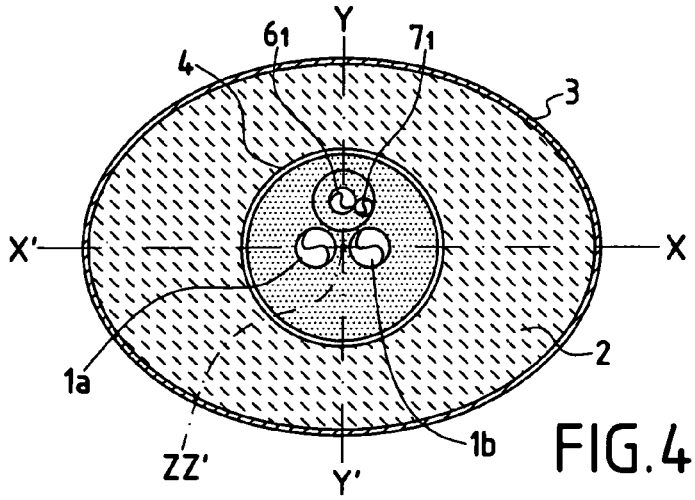
Figure 5:
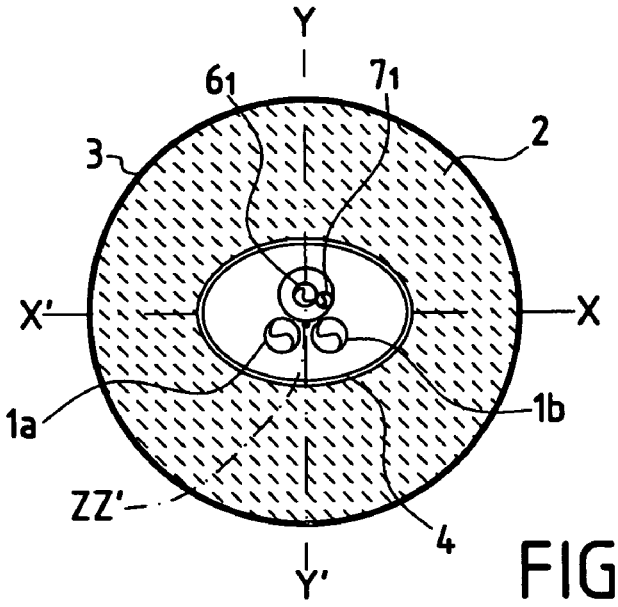
Figure 6:
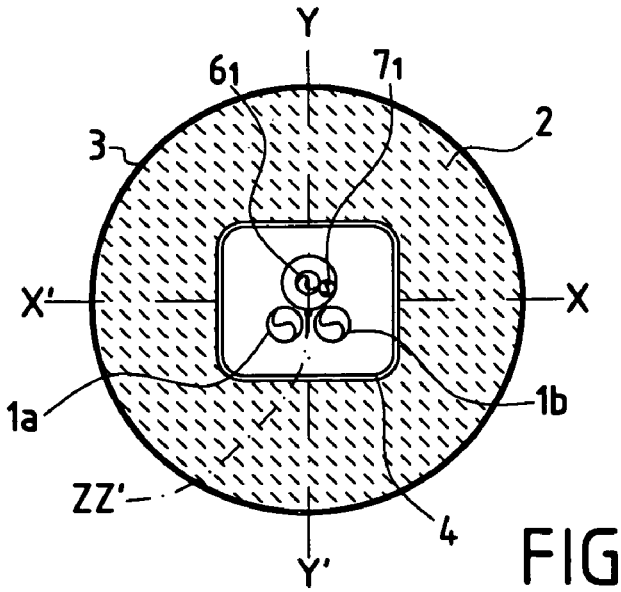
Figure 7:
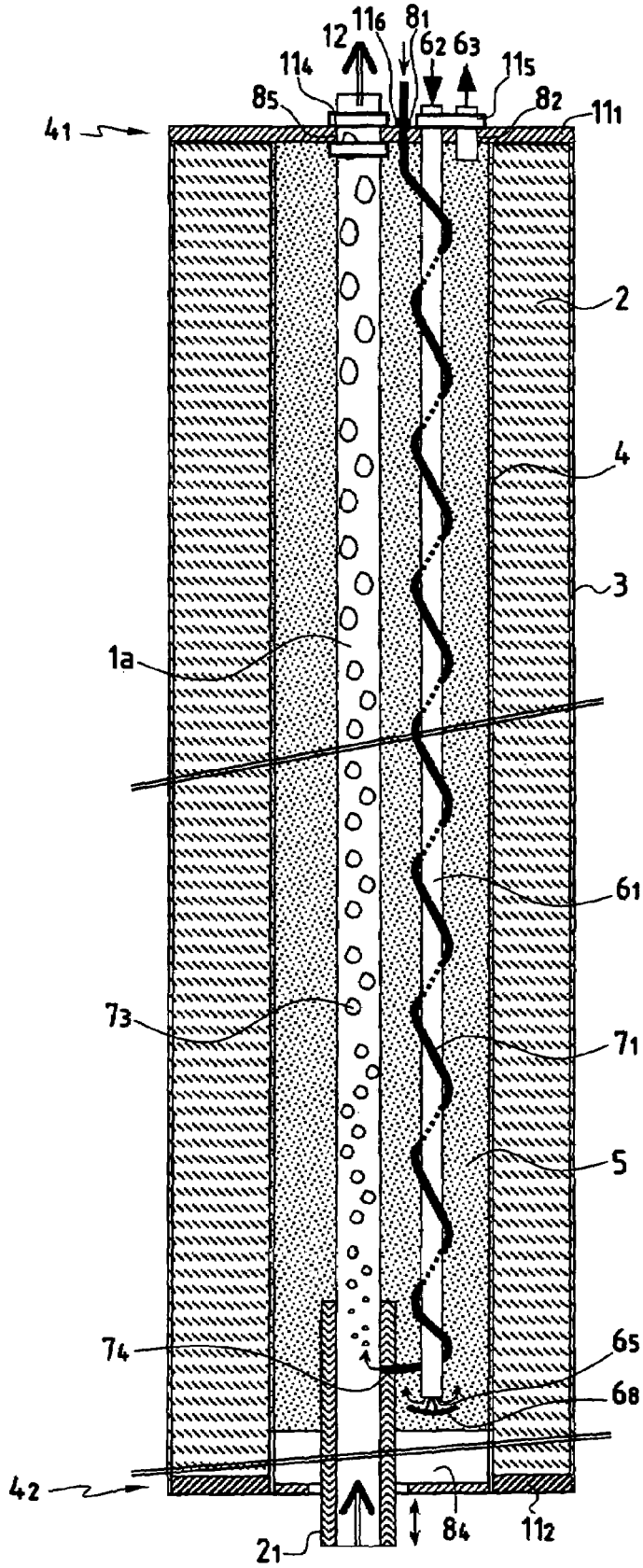
Figure 8:
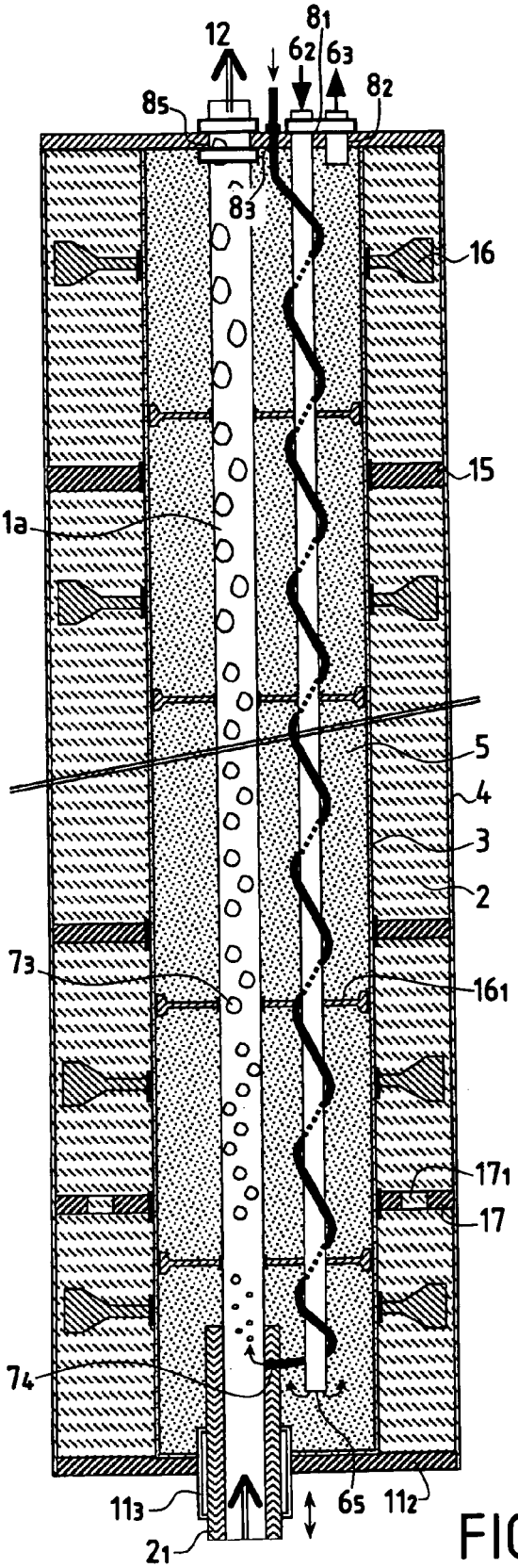
Figure 9:
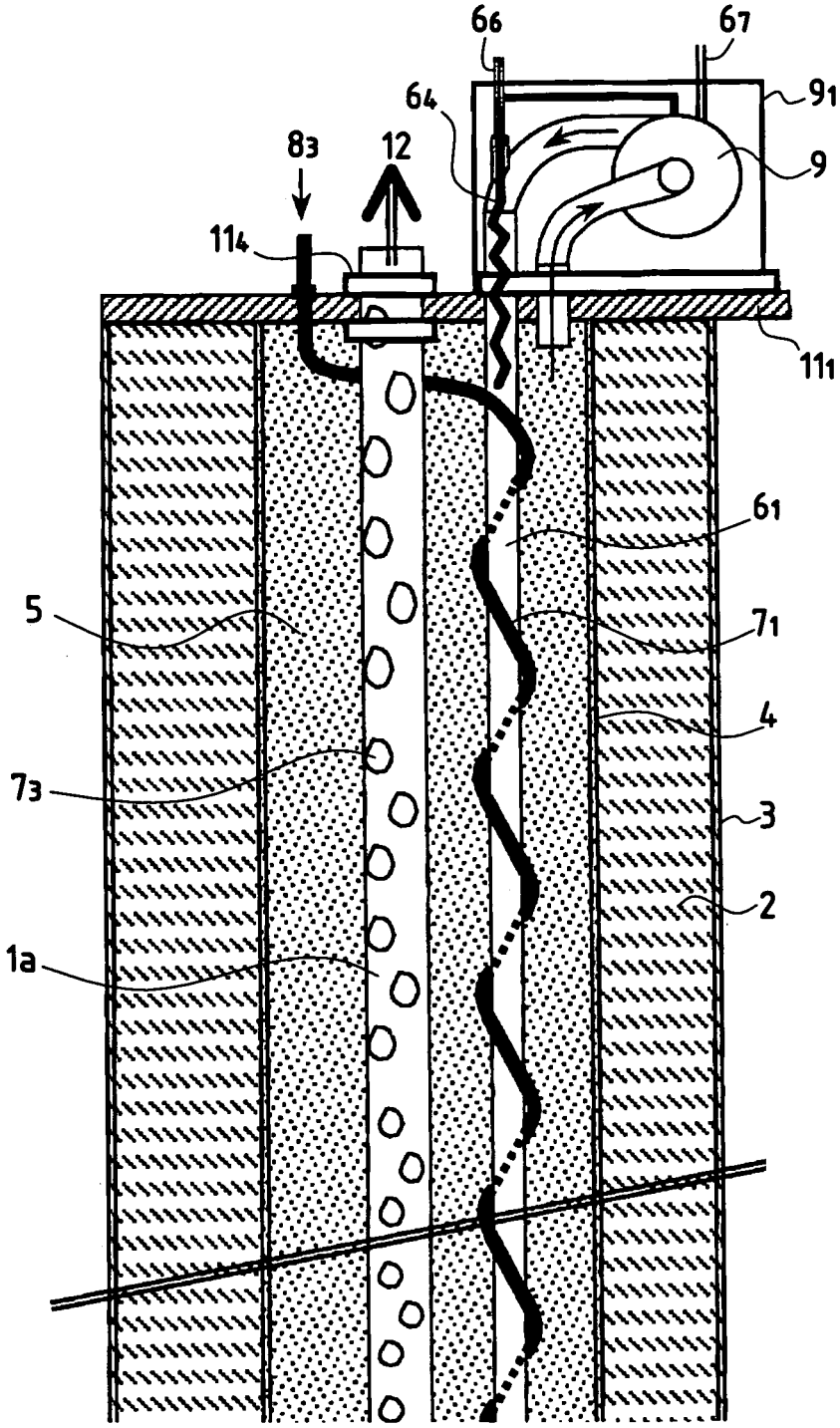
Figure 10:
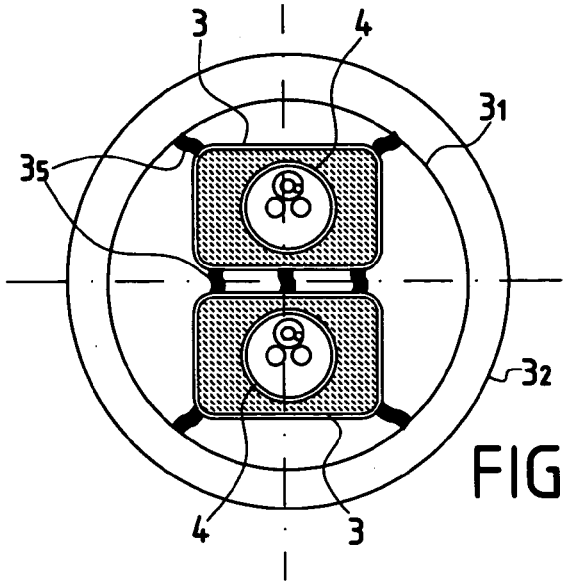
Figure 11:
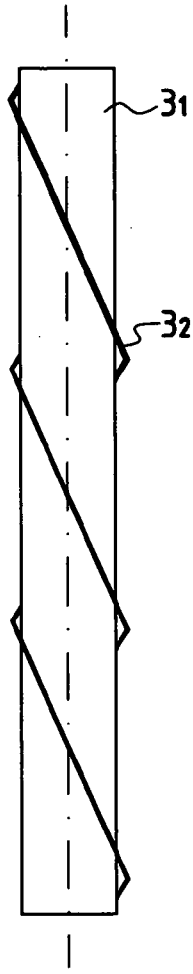

FIGS. 2, 3, and 4 are cross-sections through lagging and heating apparatus of the invention having an outer casing 3 respectively in a circular configuration (FIG. 2), of rectangular type (FIG. 3), and of oval type (FIG. 4), the internal chamber 4 containing two production pipes 1*a*, 1*b*, a gas-injection pipe 71, and a heating pipe $\mathbf{6}_1$;

FIGS. 5 and 6 are sections through lagging and heating apparatus of the invention of inverted type, i.e. with an outer casing 3 of circular configuration and an internal chamber 4 of oval type configuration (FIG. 5) and of rectangular configuration (FIG. 6):

FIG. 7 is a side view in section through lagging and heating apparatus 1 of the invention containing a production pipe 1*a*, a heating pipe $\mathbf{6}_1$ for delivering heat-transfer fluid, passing along an internal heating chamber 4, itself being surrounded by peripheral thermal insulation with a coating of lagging 2, the bottom portion of the apparatus being in direct communication with sea water;

FIG. 8 shows a variant of FIG. 7 in which there can be seen devices $\mathbf{16}_1$ for holding the pipes 1*a* and $\mathbf{6}_1$ inside the internal heating chamber 4, and devices 15, 16, and 17 enabling deformation of the outer casing 3 to be controlled, with the bottom portion of the apparatus including an additional lagging system $\mathbf{2}_1$ directly around the pipe, the bottom end of the apparatus being completely enclosed at $\mathbf{11}_2$;

FIGS. 8*a* to 8*d* are cross-section views of FIG. 8 level with the leakproof partitions, the centralizing templates, and the shaping templates;

FIG. 9 is a side view in section of the top portion of apparatus of the invention as shown in FIGS. 7 or 8, and including apparatus for pumping (9) and for heating ($\mathbf{6}_4$) the heat-transfer fluid that is circulated around the loop inside the chamber 4 via the heat-transfer fluid feed pipe $\mathbf{6}_1$;

FIG. 10 is a horizontal cross-section view of a twin lagging and heating apparatus of the invention fitted on its periphery with a circular outer second casing $\mathbf{3}_1$; and FIG. 11 is a side view of the FIG. 10 apparatus in which said circular second casing $\mathbf{3}_1$ is fitted with a helix seeking to reduce turbulence phenomena under the effect of current.

DETAILED DESCRIPTION OF THE PRESENTLY PREFERRED EMBODIMENTS

Figure 1:
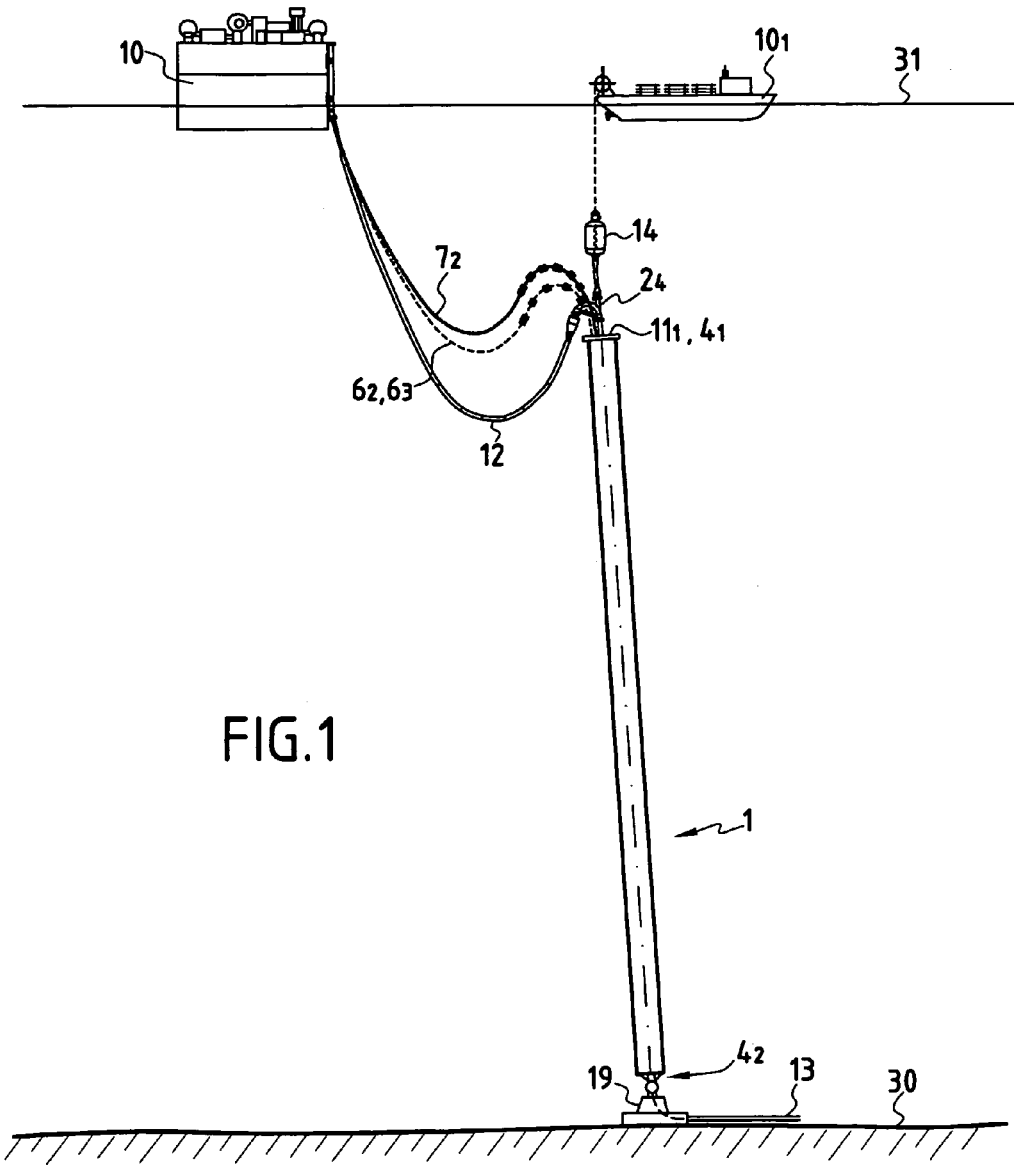
FIG. 1A is a section view of a twin pipe for circulating a heat-transfer fluid.
FIG. 1B is a view of the bottom end of the apparatus of the invention co-operating with an anchor base 19 on the sea bed 30.
Figure 1B:
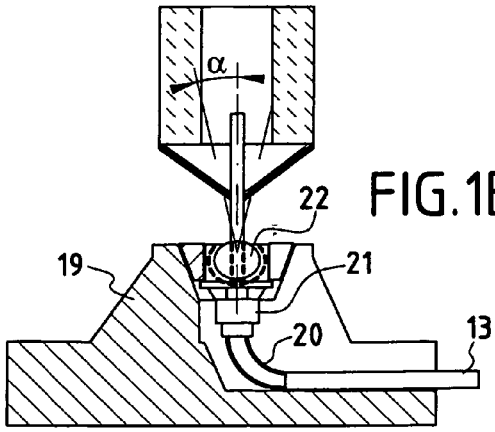
Figure 1A:
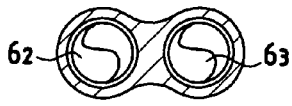

FIG. 1 shows a bottom-to-surface connection installation between an undersea pipe 13 resting on the sea bed, in particular at great depth, and a floating support 10 of the FPSO type, the installation comprising:

a) a vertical riser 1*a*, 1*b* connected at its bottom end to at least one said undersea pipe 13 resting on the sea bottom, and at its top end to at least one float 14, said vertical riser being included in a lagging and heating apparatus 1 of the invention, said vertical riser corresponding to said main pipe, and said internal chamber 4 extending over a depth of at least 1000 meters;

b) a flexible connection pipe 12 providing a connection between a floating support 10 and the top end of said vertical riser 1;

c) a twin external flexible pipe $\mathbf{6}_2$, $\mathbf{6}_3$ for circulating (respectively feeding and returning) the heat-transfer fluid 5 between the floating support 10 and said first and second orifices $\mathbf{8}_1$, $\mathbf{8}_2$ at the first end $\mathbf{4}_1$ of the internal chamber 4, and a said external flexible pipe for injecting gas $\mathbf{7}_2$; and d) the connection between the bottom end of the vertical riser 1*a*, 1*b* and a said undersea pipe 13 resting on the sea bottom taking place via an anchor system comprising a base 19 placed on the sea bottom, said base 19 serving to hold and guide junction elements between the bottom end of the vertical riser 1*a*, 1*b* and the end of said pipe 13 resting on the sea bottom, and said junction elements comprising a curved pipe element 20 and a pipe coupling element 21 together constituting a single automatic connector, and said vertical riser 1*a*, 1*b* having in its bottom end portion a flexible joint 22 enabling the vertical riser 1*a*, 1*b* situated above said flexible joint 22 to move angularly, and said junction elements comprising said flexible joint 22 or a vertical riser portion situated under said flexible joint 22.

The various flexible pipes $\mathbf{6}_2$, $\mathbf{6}_3$, $\mathbf{7}_2$, and 12 are suspected over the side of the FPSO and are connected to the top of the installation, the installation being referred to below as a tower, either at a top plate $\mathbf{11}_1$ or via a swanneck device 24. All of the flexible pipes take up a catenary configuration. The installation has a swanneck-shaped device 24 providing connection between the top end of said vertical riser 1*a*, 1*b* and a said connection pipe 12 leading to the floating support 10 so as to make it possible to act on the inside of said vertical riser from the top end of said float 14 through said swanneck-shaped device 24 so as to access the inside of said vertical riser 5 and clean it by injection liquid and/or by scraping the inside wall of said vertical riser 5, and then, where appropriate, the inside wall of said undersea pipe 13 resting on the sea bed.

Said production flexible pipe 12 is thus connected to the swan-neck 24 having connected to the top thereof a large-capacity float 14. The swan-neck 24 is connected to the float via a flexible pipe, thus making it possible from the surface to undertake cleaning action in the vertical pipe 1*a* from a ship $\mathbf{10}_1$ fitted with coiled-tubing equipment, known to the person skilled in the art. The production pipe 1*a* passes along the full length of the lagging and heating apparatus 1 of the invention and terminates at its bottom end via a leaktight flexible joint 22 of inside diameter corresponding substantially to the diameter of the main pipe 1*a*. The base is anchored on the sea bottom 30 and is connected via a pipe bend 20 and an automatic connector 21, the undersea pipe 13 resting on the sea bottom 30. As explained above, said flexible joint 22 allows the lagging and heating apparatus 1 to move angularly under the effects of swell and current, and is also capable of withstanding the vertical tensioning forces created by the float 14, and also by the buoyancy, if any, of the thermally insulating components integrated in the lagging and heating apparatus 1.

The twin pipe for circulating heat-transfer fluid $\mathbf{6}_2$, $\mathbf{6}_3$ and the gas feed pipe $\mathbf{7}_2$ extending between the floating support 10 and the top of the lagging apparatus 1 co-operate with respective orifices $\mathbf{8}_1$, $\mathbf{8}_2$, and $\mathbf{8}_3$ provided in the top end transverse partition $\mathbf{11}_1$, also referred to herein as the top "plate" $\mathbf{11}_1$, at the top $\mathbf{4}_1$ of the lagging and heating apparatus 1 of the invention. As shown in FIGS. 7 to 9, the top plate $\mathbf{11}_1$ is secured to the vertical production pipe 1*a* which passes through it at $\mathbf{8}_5$, and it also supports the outer casing $\mathbf{3}_1$ and the tubular peripheral wall of the internal chamber 4. Thus, the production pipe 1*a* supports all of the tension created by the float 14, and in addition supports the top plate $\mathbf{11}_1$ together with the elements constituting the lagging and heating apparatus 1 consisting in the outer casing 3 and the internal chamber 4.

FIGS. 7 to 9 show the heating and lagging apparatus 1 of the invention, which comprises:

- the main undersea pipe 1*a* of vertical riser 1*a* for conveying a flow of hot oil;
- an internal chamber 4 of circularly cylindrical shape, with said vertical riser 1*a* being contained therein; and
- a said outer casing 3, likewise of cylindrical shape and coaxial about said internal chamber 4.

The lagging and heating means are constituted by:

- a thermally insulating coating 2 occupying the space between the internal chamber 4 and the outer casing 3; and
- a heat-transfer fluid 5 flowing inside the internal chamber 4 from its bottom end $\mathbf{4}_2$ to its top end $\mathbf{4}_1$ level with said second orifice $\mathbf{8}_2$ passing through the top plate $\mathbf{11}_1$.

The heat-transfer fluid is taken to the top of the lagging and heating apparatus 1 of the invention by the external flexible pipe $\mathbf{6}_2$ which is connected to an internal pipe $\mathbf{6}_1$ for conveying a flow of heat-transfer fluid inside the chamber 4, via the first orifice $\mathbf{8}_1$ passing through the top plate $\mathbf{11}_1$.

The internal pipe $\mathbf{6}_1$ extends parallel to the main pipe 1*a* in the longitudinal direction ZZ' of the internal chamber 4 so that the heat-transfer fluid opens out into the internal chamber 4 at the end $\mathbf{6}_5$ of said feed pipe $\mathbf{6}_1$ that is close to the bottom end $\mathbf{4}_2$ of the lagging and heating apparatus 1. The flow of heat-transfer fluid 5 inside the chamber 4 is driven by suction through the outlet orifice $\mathbf{8}_2$ at the top $\mathbf{4}_1$ of the lagging and heating apparatus 1 in two variant embodiments.

In a first variant as shown in FIGS. 7 and 8, the second orifice $\mathbf{8}_2$ for outlet of the heat-transfer fluid is connected to a second external flexible pipe $\mathbf{6}_3$ for returning said heat-transfer fluid to the floating support 10, and it is on board the floating support 10 that there is to be found a system for pumping and heating the fluid.

In a second variant embodiment as shown in FIG. 9, a pumping apparatus 9 is installed on the top plate $\mathbf{11}_1$ so as to co-operate with said first orifice $\mathbf{8}_1$ for heat-transfer fluid 5 and said second orifice $8_2$ for outlet of heat-transfer fluid, thereby enabling the heat-transfer fluid to be caused to circulate in a loop inside the chamber 4.

As shown in FIG. 9, the pump 9 may be electrical, hydraulic, or pneumatic, and it is contained inside a container $9_1$ mounted on the top plate $11_1$. The suction orifice of the pump is connected to the orifice $8_2$ for outlet of heat-transfer fluid through the plate $11_1$, and the outlet orifice of the pump is connected to the feed orifice $8_1$ for feeding fluid into the chamber 4 through the top plate $11_1$. The electrical resistance element $6_4$ dips inside the pipe $6_1$ over a length that is sufficient to enable the heat-transfer fluid 5 to be raised to a suitable temperature prior to continuing its travel down towards the bottom of the chamber 4. To clarify the drawing, the orifice $8_3$ for the gas-injection pipe $7_1$ is shown offset to the left relative to the configuration shown in FIGS. 7 and 8. The electrical resistance element $6_4$ and the motor of the pump 9 are powered by an electrical cable $6_6$ occupying a catenary configuration leading to the side of the FPSO (not shown). The external flexible pipe $6_2$ for feeding heat-transfer fluid co-operates with the orifice $6_7$ and enables the chamber 5 to be filled with heat-transfer fluid. The pump 9 and the electrical resistance element $6_4$ inside the container $9_1$ can be maintained since the container $9_1$ is independent and is connected to the top plate $11_1$ by means that are not shown. It is thus possible to disconnect the container $9_1$ and hoist it to a tender $10_1$ located vertically along the top plate $11_1$. After being repaired or replaced, the container $9_1$ is lowered back down and the electrical cables are reconnected, with isolating valves (not shown) being opened and the heat-transfer fluid 5 again being capable of being circulated and heated, depending on requirements.

This second embodiment with the pump 9 installed at the top of the lagging apparatus 1 is advantageous when the heat needed for heating the heat-transfer fluid 5 is produced by electricity generators. Otherwise, the first variant shown in FIGS. 7 and 8 is advantageous when the heat is recovered from the equipment existing on board the floating support, and in particular from its gas turbines, diesel engines, or furnaces for eliminating polluting substances.

FIGS. 7 and 8 show that the top plate $11_1$ is secured to the main pipe 1*a* via reinforcement $11_4$ and is supported thereby. The wall of the internal chamber 4 and the outer casing 3 are secured in leaktight manner to the top plate $11_1$. The internal heat-transfer fluid feed pipe $6_1$ is supported in leaktight manner by the top plate $11_1$ via reinforcement $11_5$, said feed pipe $6_1$ passing along the full height of the internal chamber 4 so as to open out at a point $6_5$ close to the bottom $4_2$. The heat-transfer fluid 5 thus fills all of the space that exists between the various pipes 1*a*, $6_1$ inside the internal chamber 4, which space is defined at its top end by the top plate $11_1$. The fluid then leaves via the second orifice $8_2$ so as to return to the floating support 10 via the external flexible connection $6_3$ where the heat-transfer fluid is heated and then pumped back towards the feed orifice $8_1$ via the external flexible feed pipe $6_2$ so as to ensure that it circulates continuously, thereby maintaining all of the components at a temperature that prevents pipes becoming blocked by the formation of paraffin or hydrates. The internal gas-injection pipe $7_1$ is secured in leaktight manner to the top plate $11_1$ via reinforcement $11_6$ from which it is suspended. The internal gas-injection pipe $7_1$ is advantageously spiral-wound around the hot heat-transfer fluid feed pipe $6_1$ prior to being finally connected directly at $7_4$ to the main production pipe 1*a* so as to perform so-called gas-lift.

In the production configuration, gas is injected under pressure slightly greater than the internal pressure that exists in the main pipe 1*a* at the orifice $7_4$, e.g. 0.5 bars to 2 bars greater, thereby producing bubbles $7_3$ within the crude oil, having the effect of modifying its density and thereby accelerating the fluid stream. As the bubbles $7_3$ rise, the hydrostatic pressure within the crude oil decreases, thereby causing the volume of the bubbles to increase and thus decreasing the apparent density of the oil and accelerating the process of transferring crude oil from the bottom of the sea to the FPSO.

The spiral disposition of the internal gas-injection pipe $7_1$ presents three particular advantages:

- firstly, the gas-injection pipe $7_1$ is very close to the internal pipe $6_1$ feeding hot heat-transfer fluid, thereby ensuring that the gas is maintained at a good temperature until it is injected into the base of the main production pipe 1*a;*
- secondly, since said pipe $7_1$ is held securely at its top end to the top plate $11_1$ via a rigid connection $11_5$, and at its bottom end to the injection orifice $7_4$, differential expansion between the main production pipe 1*a* and the gas-injection pipe $7_1$ is accommodated without damage by elastic deformation of the spiral formed by said pipe $7_1$, which is wound in a spiral around the heat-transfer fluid pipe $6_1$, thus making it possible to use ordinary steel pipe; and
- finally, in the event of the installation stopping, the riser 1*a* will be full of crude oil, which also penetrates into the gas-injection pipe $7_1$ up to a certain height since there is no check valve at the injection orifice $7_4$; such check valves are avoided since they require maintenance and run the risk of leading to breakdowns in which they no longer operate properly, e.g. by leaking or by becoming blocked in the open or the closed position. Thus, on restarting, it is advantageous to cause the heat-transfer fluid 5 to circulate in the chamber 4, thereby immediately fluidizing the crude oil contained in the gas-injection pipe $7_1$ spiral-wound in direct contact with the hot fluid feed pipe $6_1$, and enabling a high temperature to be maintained while warming the crude oil contained in the main production pipe 1*a* little by little. By maintaining gas at a sufficiently high pressure, once the oil in the riser 1*a* becomes sufficiently fluid, the gas-injection pipe $7_1$ vents rapidly and gas-lift comes into action as soon as possible, thereby optimizing restarting the installation.

In FIG. 7, the insulating covering 2 is confined in the space that extends between the top plate $11_1$, the internal chamber 4, the outer casing 3, and the transverse partition $11_2$ situated at the bottom end $4_2$ of the lagging and heating apparatus 1. This transverse end partition $11_2$ at the bottom end $4_2$ of the apparatus is open in its center via an orifice $8_4$ so that the inside of the chamber 4 is in direct contact with sea water at the bottom of the apparatus 1. Insofar as the heat-transfer fluid is sufficiently poorly miscible with sea water and is of lower density, an interface zone arises between the hot heat-transfer fluid and the sea water. The heat-transfer fluid may be hot fresh water and any mixing that might occur between the two waters does not present any major drawback other than locally losing a small portion of the heat from the heat-transfer fluid. In addition, in order to improve thermal insulation of the riser 1, it is advantageous to have additional insulation $2_1$, e.g. syntactic foam or a pipe-in-pipe section extending over a height of 30 m to 40 m, for example, centered on the interface zone between the heat-transfer fluid and sea water, in the longitudinal direction ZZ'. Thus, by disposing the bottom end $6_5$ of the heat-transfer fluid feed pipe $6_1$ at 20 m above the bottom point $4_2$ of the internal chamber 4, for example, and more advantageously by fitting the end $6_5$ of the heat-transfer fluid feed pipe $6_1$ with a deflector $6_6$, the interface between hot water and cold water is kept well above the bottom point $4_2$ of the internal chamber 4, thereby minimizing wasted heat losses. In addition, the additional insulation $2_1$ extends well below the deflector $6_8$, thereby guaranteeing both excellent insulation and thoroughly effective heating of the bottom portion of the pipe 1*a*. This embodiment in which the bottom end $4_2$ of the internal chamber 4 is open via an orifice $8_4$ of diameter greater than the diameter of the main pipe 1*a* fitted with its additional insulating coating $2_1$ is advantageous since it allows the riser 1*a* to lengthen and shorten due to temperature variations without leading to mechanical interface difficulties at the bottom end connection between the main pipe 1*a* and the bottom transverse partition $11_2$ of the lagging apparatus 1 of the invention.

FIG. 8 shows a variant embodiment in which the transverse bottom end partition $11_2$ co-operates with a tubular sleeve $11_3$ surrounding the bottom end of the main pipe 1*a* fitted with its additional insulating coating $2_1$ so as to confine the inside of the chamber 4, preferably in leaktight manner. This minimizes exchanges with the outside, which can be preferable when the heat-transfer fluid is a polluting fluid such as gas oil. In addition, gas oil is advantageous because of its low specific gravity (d=0.85), thereby enabling it to contribute to the buoyancy of the lagging and heating apparatus 1 as a whole. The outside surface of the insulator means $2_1$ surrounding the main pipe 1*a* at its bottom end slides with small clearance inside the tubular sleeve $11_3$, and in order to eliminate any risk of leakage, it is advantageous to install sealing gaskets (not shown), and at least one of the two ends of the tubular sleeve $11_3$, which sleeve is secured to the bottom end partition $11_2$.

FIG. 8 shows the inside of the internal chamber 4 contains centralizing elements $16_1$ which enable the pipes 1*a* and $6_1$ to be maintained substantially parallel in the longitudinal direction ZZ' of the chamber, while still allowing them to move due to differential expansion along said axis ZZ'.

Figure 8A:
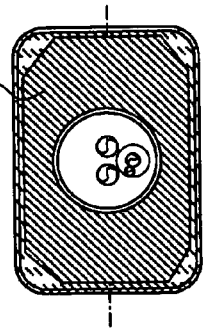
Figure 8B:
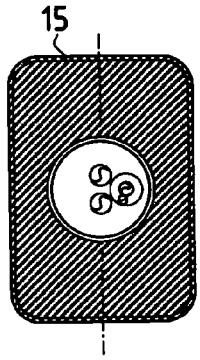

FIG. 8 also shows a variant embodiment with intermediate leaktight partitions 15, centralizing templates 16, and shaping templates 17 in the space between the internal chamber 4 and the outer casing 3 in the event of the insulating coating 2 being made of a material that might migrate. These intermediate leaktight partitions 15, centralizing templates 16, and shaping templates 17 limit expansion and contraction of the insulating material that is subject to migration, and thus limit deformation of the outer casing 3 as explained above. The leaktight intermediate transverse partitions 15 and the end partitions $11_1$ and $11_2$ are made of a securely-closed rigid structure having the wall of said internal chamber 4 passing therethrough and secured to the wall of the outer casing 3; they are spaced apart at regular intervals preferably of at least 200 m in the direction ZZ'. In the space between two leaktight transverse partitions $11_1$, $11_2$, there is disposed at least one centralizing template 16. Each centralizing template 16 is constituted by a rigid piece secured to the wall of the internal chamber 4 and presenting a shape that allows for limited displacement of the outer casing 3 both in contraction and in expansion. This embodiment is suitable for an internal chamber having a rigid wall, in particular one of circular shape, and for an outer casing 3 made of flexible or semi-rigid material suitable for remaining in contact with the outside surface of the insulating lagging 2 when it deforms. FIG. 8*a* shows an embodiment in which the perimeter of the cross-section of the cylindrical outside free surface of the rigid piece constituting the centralizing template 16 is set back from the wall of an intermediate leaktight partition 15 and limits deformation of the outer casing 3 by causing it to come into mechanical abutment against the rigid piece 16 at at least two opposite points on the perimeter of the cross-section of said outer casing 3. As described in FR 2 821 915, the rigid piece 16 presents a portion of its cylindrical outside free surface that is set back far enough from the surface of the outer casing 3 and/or that presents perforations passing through it so as to create a space that allows insulating material 2 to be transferred through the centralizing template or around the centralizing template 16.

In a variant embodiment (not shown), when the outer casing 3 is made of a rigid material and presents a horizontal cross-section of circular profile, and when it is the internal chamber 4 that is made out of a material that is flexible or semi-rigid, preferably having a transverse horizontal section of oval or elongate and rectangular profile, the rigid piece constituting the centralizing template is secured to the outer casing 3, and it is the cylindrical inside free surface of the rigid piece 16 which is then set back from the wall of the internal chamber 4 so as to allow the wall of the internal chamber 4 facing the centralizing template 16 to expand or contract.

Figure 8C:
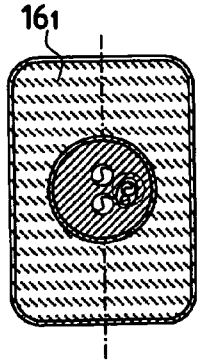
Figure 8D:
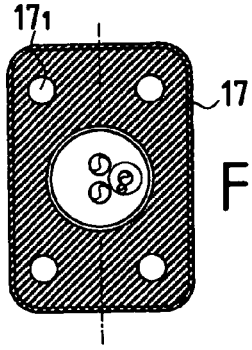

It is also advantageous to provide shaping templates 17 between two centralizing templates 16 as shown in the bottom compartment between the bottom end partition $11_2$ and the first leaktight intermediate transverse partition 15 in FIG. 8. The shaping template 17 is constituted by a rigid structure secured to the walls of the outer casing 3 and of the internal chamber 4. In FIG. 8*c*, the shaping template 17 presents openings $17_1$ enabling matter that is subject to migration in said insulating material 2 to pass through the shaping template 17 so as to obtain the technical effect explained above and described in FR 2 821 915.

FIGS. 2 to 6 show various types of geometrical configuration for the horizontal cross-section of the internal chamber 4 and of the outer casing 3, firstly the internal chamber 4 and the outer chamber 3 may both be constituted by rigid material and present a horizontal cross-section of circular configuration. This type of configuration can be suitable when the thermally insulating material 2 is a rigid material such as syntactic foam.

Nevertheless, when the thermally insulating material 2 is a material that is subject to migration, in particular a material of the gel type, and more particularly still a phase-change compound such as a paraffin, or indeed a combination of those various systems for insulation and energy storage purposes, it is preferable for the outer casing 3 and/or the internal chamber 4 to be made out of a flexible or semirigid material capable of tracking the deformations of said insulating material. Various configurations can be envisaged.

It should be observed that in FIGS. 2 to 6, a lagging and heating apparatus is shown comprising a bundle of pipes 1*a*, 1*b* disposed in parallel inside the internal chamber 4 extending along its longitudinal direction ZZ'.

In FIGS. 3 and 4, lagging apparatus 1 is shown that is more particularly adapted to an insulating covering 2 of the gel type or of a phase-change material subject to large changes in volume due to changes of temperature and/or to phase-change phenomena. Such apparatuses have the ability to absorb large variations in volume by "rounding" the shape of the outer casing shown in FIG. 3 as having a horizontal cross-section of rectangular type with rounded corners and in FIG. 4 as having a horizontal cross-section of oval configuration. The outer casing 3 expands towards a circular shape without leading to significant stresses in the outer casing 3, whenever the internal volume increases. In this version, the outer casing can be made of a material that is semi-rigid, a steel, or any other metal, or indeed out of a composite material. In the embodiments of FIG. 3, the wall of the internal chamber 4 may also be made of a semi-rigid material, but it is preferably made of a material of rigid type.

In FIGS. 5 and 6, there can be seen an inverse configuration for the horizontal cross-section of the internal chamber 4 and the outer casing 3. The shape that is deformable under the effect of the insulating material 2 expanding/contracting is constituted by the wall of the internal chamber 4 whose horizontal cross-section is of elongate shape of the rectangular type having rounded corners (FIG. 6) or of the oval type (FIG. 5), while the outer casing 3 is then of circular configuration and can be made of a rigid material. Thus, when the insulating material 2 shrinks, the wall of the chamber 4 tends to take up a round shape, whereas it flattens when the insulating material 2 expands.

FIG. 10 is a horizontal section through an installation having two lagging and heating apparatuses 1 of the invention, each presenting an outer casing 3 of horizontal cross-section that is rectangular in profile with rounded corners. These two apparatuses 1 are installed in the center of a second outer casing $\mathbf{3}_1$ that is circular and that acts as a shield. Shielding circular second casings have also been described in the state of the art. Said circular second casing $\mathbf{3}_1$ minimizes the hydrodynamic coefficients specific to the assembly and thus the forces due to sea currents. This circular second casing $\mathbf{3}_1$ is secured to the apparatuses 1 via resilient studs $\mathbf{3}_5$ of elastomer or thermoplastic material, or indeed merely by springs. In FIG. 11, there can be seen fins $\mathbf{3}_2$ of spiral shape fitted to the outside of the circular section second casing $\mathbf{3}_1$ and serving to prevent vortices or turbulence forming and separating under the effect of sea currents. These dispositions are also known to the person skilled in the art and other equivalent dispositions could be envisaged.

The invention is described above in detail for a rising column, however it would remain within the spirit of the invention if the various dispositions of the invention were to be applied to undersea pipes resting on the sea bottom.

The invention claimed is:

1. Apparatus for heating and lagging at least one undersea main bottom-to-surface connection pipe for carrying a flow of hot effluent, the apparatus comprising:

a covering of at least one thermally insulating material surrounding said at least one main pipe;

said insulating covering being covered by a leaktight outer protective casing;

an internal chamber with a solid wall of cylindrical shape and coaxially disposed inside said outer casing, such that:

said insulating covering surrounds said internal chamber and is disposed within an annular space between said outer casing and said internal chamber;

said at least one main pipe is contained inside said internal chamber; and said heat-transfer fluid surrounds said at least one main pipe and circulates longitudinally between both longitudinal extremities of said internal chamber; and means suitable for maintaining the temperature of a heat-transfer fluid and for causing it to circulate inside said internal chamber.

2. Apparatus according to claim 1, wherein said internal chamber conveys at least one internal gas-injection pipe suitable for enabling gas to be injected into said main pipe, said internal gas-injection pipe being connected to said main pipe at one end in the longitudinal direction of said main pipe inside said internal chamber, and said gas-injection pipe extending outside said internal chamber in the form of an external gas-injection pipe connecting said internal gas-injection pipe to a floating support.

3. Apparatus according to claim 1, wherein said fluid-circulation means for circulating a heat-transfer fluid comprise at least one internal heat-transfer fluid feed pipe extending in the longitudinal direction inside said internal chamber from a first orifice situated at a first end of the internal chamber, as far as the vicinity of the second end of said internal chamber, and a second orifice for outlet of said heat-transfer fluid, said internal heat-transfer fluid feed pipe being situated beside said main pipe, between it and said outer insulating material.

4. Apparatus according to claim 2, wherein said internal gas-injection pipe is a pipe that is spiral-wound around said internal heat-transfer fluid feed pipe inside said internal chamber.

5. Apparatus according to claim 3, wherein said internal heat-transfer fluid feed pipe is extended from said first orifice to a floating support by an external flexible pipe for feeding said heat-transfer fluid, and said second orifice for outlet of heat-transfer fluid is connected to a second external flexible pipe for returning said heat-transfer fluid to said floating support.

6. Apparatus according to claim 3, wherein said internal heat-transfer fluid feed pipe is connected to heat-transfer fluid circulation means comprising a pump co-operating at said first end of the internal chamber with said first orifice for feeding heat-transfer fluid and with said second orifice for outlet of heat-transfer fluid, said pump enabling the heat-transfer fluid to be circulated successively inside said internal heat-transfer fluid feed pipe, then inside the internal chamber, then out from said internal chamber via said second orifice, and finally recirculating in a loop back into said internal chamber via said first orifice, an external flexible pipe for circulating heat-transfer fluid providing a connection between said floating support and the body of the pump or said first orifice.

7. Apparatus according to claim 6, further comprising a heater means for heating the heat-transfer fluid inside said internal heat-transfer fluid feed pipe.

8. Apparatus according to claim 1, further comprising at least one transverse end partition at least a said first end, said end transverse partition supporting said main pipe and also said fluid-circulation means, and having said main pipe passing therethrough and, where appropriate, having first and second orifices enabling said heat-transfer fluid to be caused to circulate inside and outside said internal chamber via said orifices.

9. Apparatus according to claim 8, further comprising first and second transverse end partitions each at a respective one of the two ends of the internal chamber, said first end partition including, where appropriate, said first and second orifices, and said two transverse end partitions supporting said outer casing and said internal chamber and connecting them together in leaktight manner, while also ensuring, at least at a first end, that the heat-transfer fluid is confined inside the internal chamber.

10. Apparatus according to claim 9, wherein said second end partition includes a large orifice of diameter greater than that of the main pipe, through which orifice said main pipe passes, so that the heat-transfer fluid is in contact with sea water at the bottom end of the internal chamber.

11. Apparatus according to claim 9, wherein said second end partition includes an orifice surrounding and secured to a tubular sleeve inside which said main pipe can slide with little clearance.

12. Apparatus according to claim 1, wherein said main pipe is covered in a second insulating covering, at least at said second end of the internal chamber, said heat-transfer fluid circulating in said internal chamber outside said second covering.

13. Apparatus according to claim 12, wherein said second covering is constituted by a thermally insulating material, said solid material directly surrounding said main pipe.

14. Apparatus according to claim 1, wherein said insulating covering comprises an insulating material that is subject to migration, and at least one of said outer casing and said internal chamber is constituted by a solid material that is flexible or semi-rigid and suitable for tracking deformations of the insulating material and for remaining in contact therewith when it deforms.

15. Apparatus according to claim 1, wherein said insulating material is a phase-change material presenting a liquid/solid melting temperature greater than the temperature of the sea water environment surrounding the pipe in operation and less than the temperature above which the effluent flowing inside the pipe presents an increase in viscosity that is damaging for flow thereof in said main pipe.

16. Apparatus according to claim 15, wherein said phase-change insulating material comprises chemical compounds of the alkane family.

17. Apparatus according to claim 1, wherein said insulating material comprises an insulating mixture comprising a first compound consisting in a hydrocarbon compound such as paraffin or gas oil, mixed with a second compound consisting in a gelling compound and/or a compound having a structuring effect, in particular by cross-linking, such as a second compound of the polyurethane type, cross-linked polypropylene, cross-linked polyethylene, or silicone.

18. Apparatus according to claim 1, wherein said insulating covering comprises at least one said viscous solid material that is subject to migration and at least two intermediate transverse partitions that are leaktight, each of said intermediate transverse partitions being constituted by a closed rigid structure having said internal chamber passing therethrough and secured to the walls of said internal chamber and to said outer casing.

19. Apparatus according to claim 18, further comprising at least one centralizing template disposed at regular intervals between two of said leaktight intermediate transverse partitions in succession along said longitudinal axis, each centralizing template being constituted by a rigid piece secured to at least one of the wall of the internal chamber and of said outer casing, and presenting a shape which allows limited displacement of said outer casing or respectively of said internal chamber in contraction and in expansion facing said centralizing template, at least said outer casing or respectively said internal chamber being made of a material that is flexible or semi-rigid and suitable, where appropriate, for remaining in contact with the insulating covering when it deforms.

20. Apparatus according to claim 18, further comprising at least one shaping template constituted by a rigid structure secured to said internal chamber which passes therethrough and secured to said outer casing at its periphery, being disposed between two of said leaktight intermediate transverse partitions that are disposed in succession, each shaping template presenting openings allowing the material constituting said insulating material that is subject to migration to pass through said shaping template.

21. Apparatus according to claim 1, wherein said outer casing and said internal chamber are coaxial along a longitudinal axis and define a perimeter presenting, at rest, two axes of symmetry that are mutually perpendicular and perpendicular to said longitudinal axis, and at least one of the walls constituting said outer casing and/or said internal chamber is made of a material that is flexible or semi-rigid, while the other wall is constituted by a material that is rigid, and more preferably of cross-section that is circular in shape.

22. Apparatus according to claim 21, wherein the cross-section of the outer casing, which is formed of a rigid material is circular in shape, while the cross-section of said internal chamber is oval in shape or rectangular in shape with rounded corners.

23. Apparatus according to claim 21, wherein the cross-section of the internal chamber, which is formed of a rigid material is circular in shape, while the cross-section of the outer casing is oval in shape or rectangular in shape with rounded corners.

24. Apparatus according to claim 1, characterized in that at least one of said main pipe and said internal heat-transfer fluid feed pipe, co-operates inside said internal chamber with centralizing elements which hold said pipes substantially parallel to the axis of said internal chamber while allowing said pipes to move due to differential expansion thereof.

25. Apparatus according to claim 1 for heating and lagging a bundle of undersea main pipes, wherein the apparatus comprises at least two of said main pipes disposed in parallel inside said internal chamber.

26. A bottom-to-surface connection installation between an undersea pipe resting on the sea bottom, in particular at great depth, and a supporting float, the installation comprising:

a) at least one vertical riser connected at its bottom end to at least one said undersea pipe resting on the sea bottom, and at its top end to at least one float said vertical riser being included in apparatus according to claim 1, said vertical riser corresponding to said main pipe, and said internal chamber extending over a depth of at least 1000 meters;

b) at least one flexible connection pipe connecting the supporting float with the top end of said vertical riser; and c) an external pipe for circulating the heat-transfer fluid between the supporting float and first and second orifices at a first end of the internal chamber, and for injecting gas.

27. An installation according to claim 26, further comprising a second outer casing of circular cross-section secured to said outer protective casing of said lagging and heating apparatus.

28. A method of heating and thermally insulating at least one main undersea pipe providing a bottom-to-surface connection for delivering a flow of hot effluent to or from the bottom of the sea and the surface, the method being a heating and lagging apparatus according to claim 1 is used, and a said heat-transfer fluid is caused to flow inside a said internal chamber.

29. The method according to claim 28, wherein said heat-transfer fluid is selected from sea water, fresh water, gas oil, and oil.

30. The method according to claim 28, wherein said main pipe is heated by said flow of said heat-transfer fluid during a stage of restarting production after a prolonged stoppage.

* * * * *